US007137516B2

(12) United States Patent
Perry

(10) Patent No.: US 7,137,516 B2
(45) Date of Patent: Nov. 21, 2006

(54) DISPLAY UNIT FOR TRAILER HITCHES AND TRAILER HITCH ACCESSORIES

(75) Inventor: Greg J. Perry, Bentonville, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 130 days.

(21) Appl. No.: 10/869,156

(22) Filed: Jun. 16, 2004

(65) Prior Publication Data

US 2005/0279724 A1 Dec. 22, 2005

(51) Int. Cl.
*A47F 5/01* (2006.01)
*A47F 7/00* (2006.01)

(52) U.S. Cl. ..... 211/106; 211/70.6; 206/349

(58) Field of Classification Search ..... 211/106, 211/90.01, 70.6; 206/349
See application file for complete search history.

(56) References Cited

U.S. PATENT DOCUMENTS

| | | | | | |
|---|---|---|---|---|---|
| 815,480 | A | * | 3/1906 | Silven | 248/455 |
| 2,914,186 | A | * | 11/1959 | Milner | 211/74 |
| D191,484 | S | * | 10/1961 | Bardo | D6/566 |
| 3,003,644 | A | * | 10/1961 | Hildebrand | 211/74 |
| 3,965,826 | A | * | 6/1976 | Markham | 108/152 |
| 4,345,688 | A | * | 8/1982 | De Boer | 211/70.6 |
| 4,890,747 | A | * | 1/1990 | Sayers | 211/106 |
| 5,277,447 | A | * | 1/1994 | Blaser | 280/479.2 |
| 5,611,440 | A | * | 3/1997 | Møller | 211/70.7 |
| 5,881,906 | A | * | 3/1999 | Rogers et al. | 220/607 |
| 6,102,496 | A | * | 8/2000 | Parham | 312/138.1 |
| 6,161,718 | A | * | 12/2000 | Monbo | 220/486 |
| D436,756 | S | * | 1/2001 | Kashima | D6/463 |
| 6,299,001 | B1 | * | 10/2001 | Frolov et al. | 211/106 |
| 6,729,080 | B1 | * | 5/2004 | Zambelli et al. | 52/167.1 |
| 2006/0091092 | A1 | * | 5/2006 | Vosbikian | 211/87.01 |

* cited by examiner

*Primary Examiner*—Richard E. Chilcot, Jr.
*Assistant Examiner*—Jared W. Newton
(74) *Attorney, Agent, or Firm*—Priest & Goldstein, PLLC

(57) ABSTRACT

A hardware display unit includes a front grid having a front matrix of openings, and a rear grid having a rear matrix of openings corresponding in position to the first matrix of openings. The front grid is positioned with respect to the rear grid such that corresponding pairs of openings in the front and rear matrices together define downward sloping bays for receiving hardware. The display unit further includes side brackets mounted to side edges of the front and rear grids, the side brackets extending behind the front and rear grids for attaching the display unit to a vertical supporting structure. The display unit further includes a cap mounted to the front and rear grids. The cap includes a substantially horizontal surface extending from the front and rear grids towards a vertical supporting structure to which the first and second side brackets are attached. An adapter unit allows smaller items to be loaded into the display unit.

9 Claims, 9 Drawing Sheets

DISPLAY UNIT FOR TRAILER HITCHES AND TRAILER HITCH ACCESSORIES

BACKGROUND OF THE INVENTION

1. Field of the Invention

The present invention relates generally to improvements in the field of retailing, and more particularly to advantageous aspects of an improved display unit for bulky, heavy hardware, such as trailer hitches, trailer hitch accessories, and the like.

2. Description of Prior Art

Shelf management is an important part of the retail business. It is desirable for retail items to be shelved in a manner that allows customers to easily view and select among the shelved items. In addition, from the retailer's point of view, it is desirable for a retail shelf to hold as many items as possible in a stable configuration, and for goods in the shelf display to be easily replaced as they are sold. It is further desirable for a retailer to be able to easily count how many items of various types are in a given shelf display.

For a number of reasons, it has been problematic for a retail store to effectively display trailer hitch hardware on a shelf. Hitching a trailer to a motor vehicle typically requires a number of different pieces of hardware, including hitch balls, ball mounts, locking pins, and the like. Trailer hitch hardware typically is available in a number of different sizes and shapes, depending upon the particular trailer and motor vehicle to be hitched together. Further, certain pieces of trailer hitch hardware, such as ball mounts, may have shapes that make it difficult to stack or otherwise arrange the hardware on a shelf.

SUMMARY OF THE INVENTION

Such issues and others are addressed by the present invention, an aspect of which provides a hardware display unit. The display unit includes a front grid having a front matrix of openings, and a rear grid having a rear matrix of openings corresponding in position to the first matrix of openings. The front grid is positioned with respect to the rear grid such that corresponding pairs of openings in the front and rear matrices together define downward sloping bays for receiving hardware. The display unit further includes side brackets mounted to side edges of the front and rear grids, the side brackets extending behind the front and rear grids for attaching the display unit to a vertical supporting structure. The display unit further includes a cap mounted to the front and rear grids. The cap includes a substantially horizontal surface extending from the front and rear grids towards a vertical supporting structure to which the first and second side brackets are attached.

Additional features and advantages of the present invention will become apparent by reference to the following detailed description and accompanying drawings.

DETAILED DESCRIPTION

An aspect of the present invention provides a display unit that is suitable for use in displaying trailer hitch hardware. It is noted, however, that it is not intended to limit the invention to the display of trailer hitch hardware. It will be apparent from the present discussion and the accompanying drawings that the display system described herein may be used to display other types of products without departing from the spirit of the invention.

Figure 1:
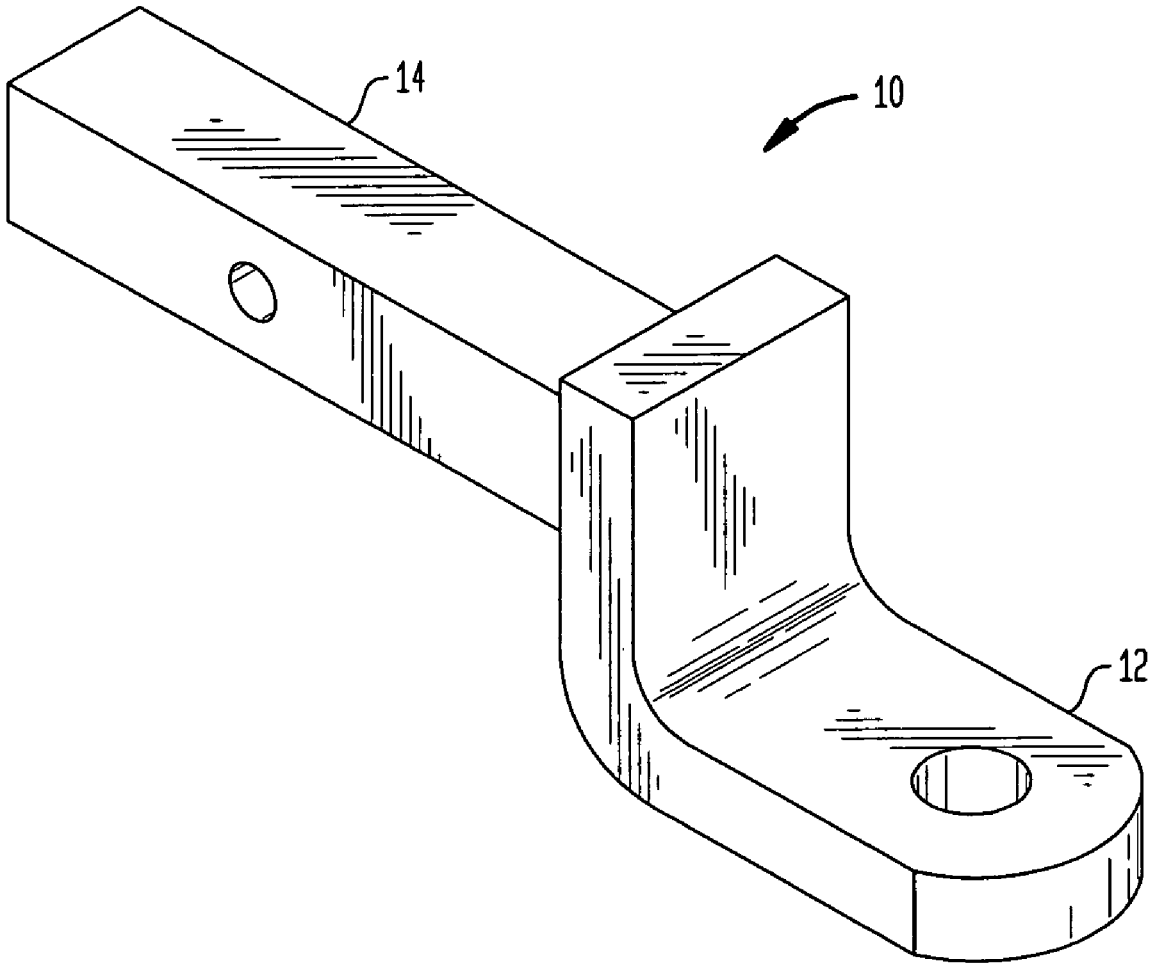
FIG. 1 (PRIOR ART)
FIG. 1 shows an isometric view of a trailer hitch ball mount according to the prior art.

Typically, a number of different types of hardware are required to hitch a trailer to a motor vehicle. This hardware includes, for example, a hitch ball, a ball mount, and hardware used to attach the ball mount to the rear of the motor vehicle. FIG. 1 shows an isometric view of a trailer hitch ball mount 10 according to the prior art. A typical ball mount 10 includes a hitch ball platform 12 onto which a hitch ball (not shown) is attached, and a draw bar 14 for attaching the ball mount 10 to a receiver unit (not shown) that has been mounted to the rear of a motor vehicle.

A typical ball mount 10 is fabricated from metal and may weigh 5–10 lbs., or more. Further, a ball mount 10 is typically not packaged in a box. Rather, a printed label is typically affixed directly onto the ball platform 12. It will thus be appreciated that a ball mount 10 has a shape that makes it awkward to display for sale. In particular, it will be seen that it is difficult to arrange ball mounts 10 into a neat, stable stack on a retail shelf. The stacking problem is aggravated by the relatively heavy weight of ball mounts, which is typically unevenly distributed along the length of the ball mount. In addition, a store selling ball mounts typically sells several different types and models of ball mounts, which vary in shape and size. As shown in FIG. 1, the ball platform 12 is generally L-shaped. However, depending upon the particular application, the shape and size of the ball platform 12 may vary significantly. In addition, the length, height and width of the draw bar 14 may also vary significantly.

Figure 2:
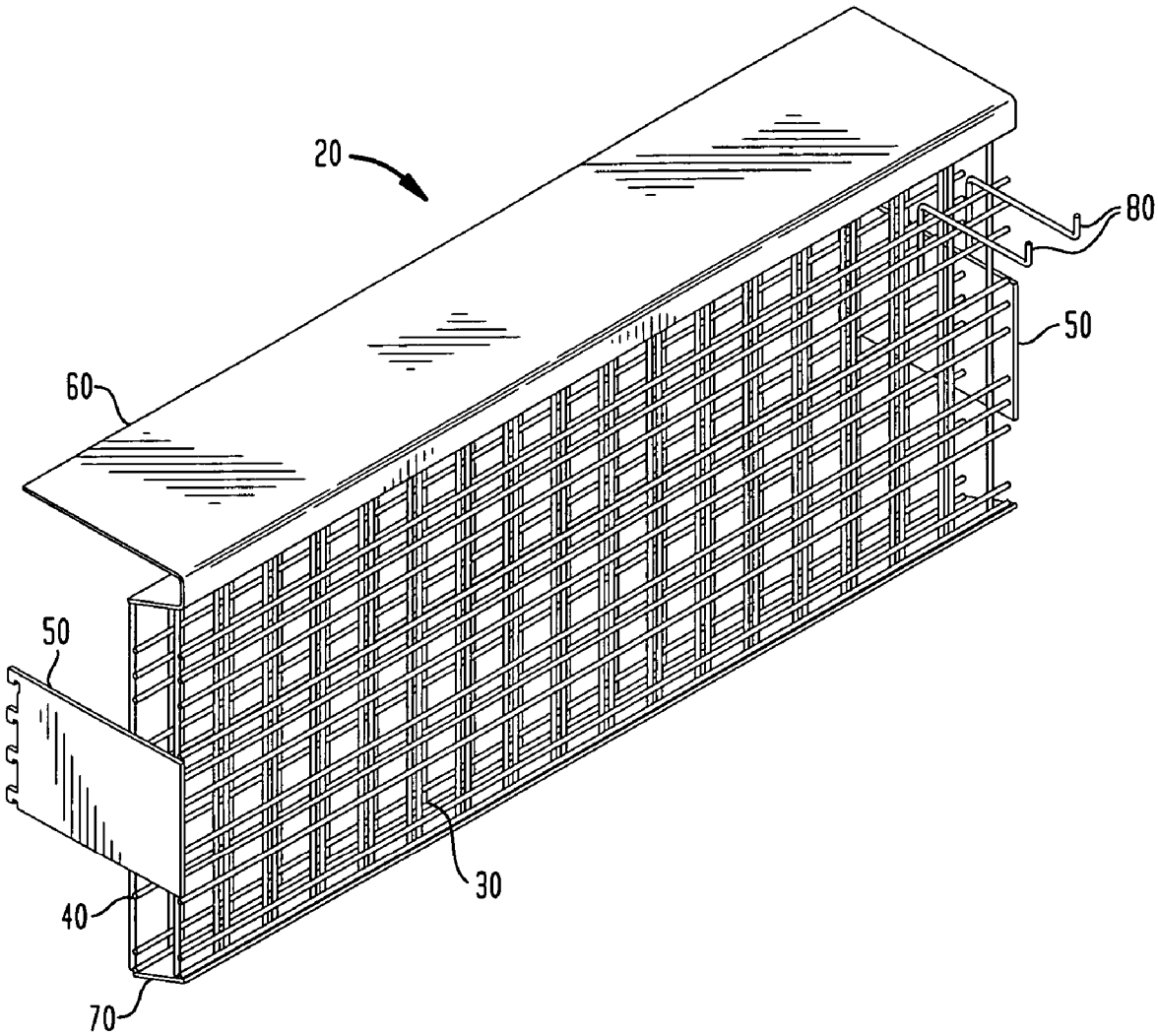
FIG. 2 shows an isometric view of a trailer hitch hardware display unit according to an aspect of the present invention.

FIG. 2 shows an isometric view of a display unit 20 according to a first aspect of the invention. Although, as discussed below, the display unit 20 is suitable for displaying trailer hitch hardware in a retail environment, it will be appreciated that the display unit 20 may be used for different purposes in different environments without departing from the spirit of the invention.

As shown in FIG. 2, the display unit 20 includes a front grid 30, a rear grid 40, a pair of side brackets 50, a cap 60, a bottom strip 70, and a pair of display hooks 80. According to one aspect of the present invention, the components of the display unit 20 are fabricated from pieces of heavy gauge wire and sheet metal that are held together using soldering, welding, or other suitable fabrication techniques.

In a presently preferred embodiment of the invention, the front and rear grids 30 and 40 are fabricated from #3/2 gauge steel wire, having a diameter of 0.2437"diameter. The left and right brackets 50 are fabricated from #12 gauge sheet steel, having a thickness of 0.1046". The cap 60 and bottom strip 70 are fabricated from #16 gauge sheet steel, having a thickness of 0.0598". The first and second hooks 80 are fabricated from #1/0 gauge steel wire, having a thickness of 0.3065". It will be appreciated that different materials and thicknesses may be used without departing from the spirit of the invention. In the present example, the length of the display unit 20, from the left side bracket 50 to the right side bracket 50, is approximately 47.9 inches. The height of the unit 20 is approximately 20.9 inches. The depth of the unit 20, not including the display hooks 80, is approximately 8.8 inches. The distance between the front and rear grids 30 and 40 is approximately 2.3 inches.

Figure 3:
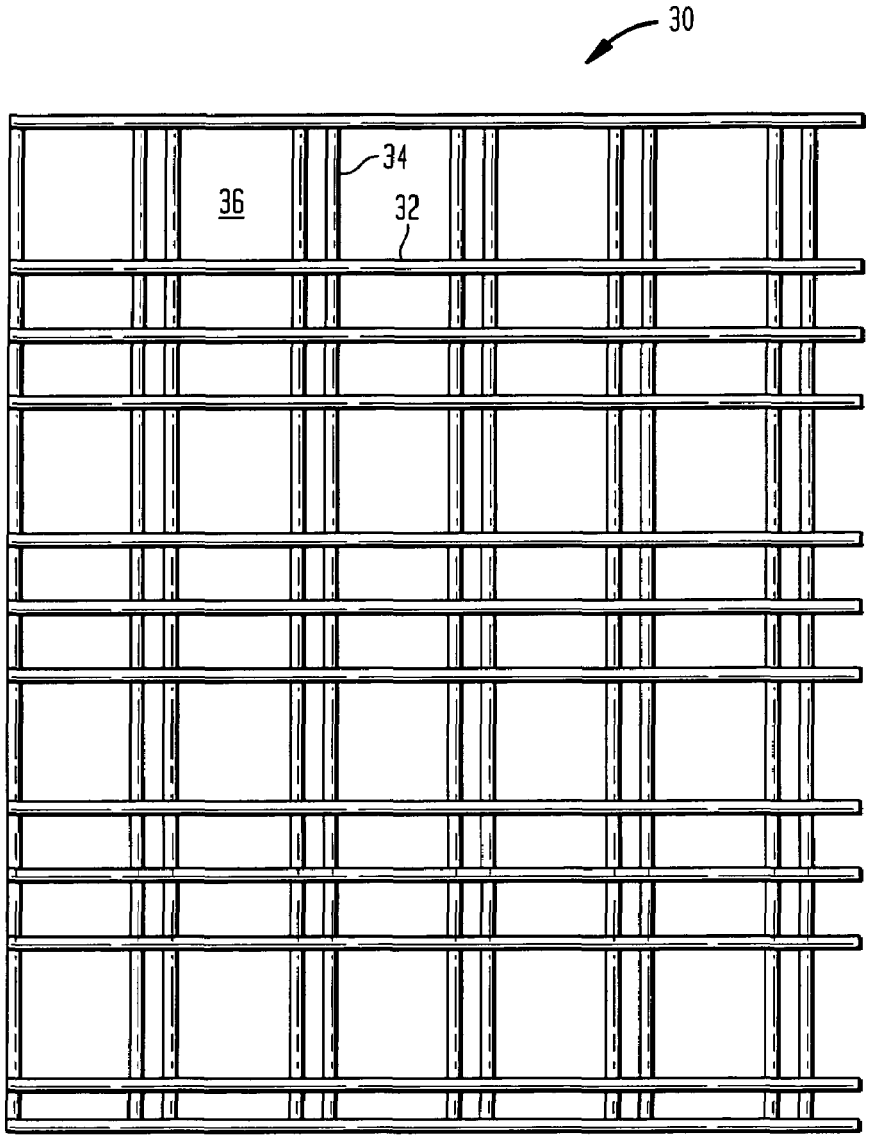
FIG. 3 shows an elevation view of a portion of a front grid suitable for use in the display unit shown in FIG. 2.
Figure 4:
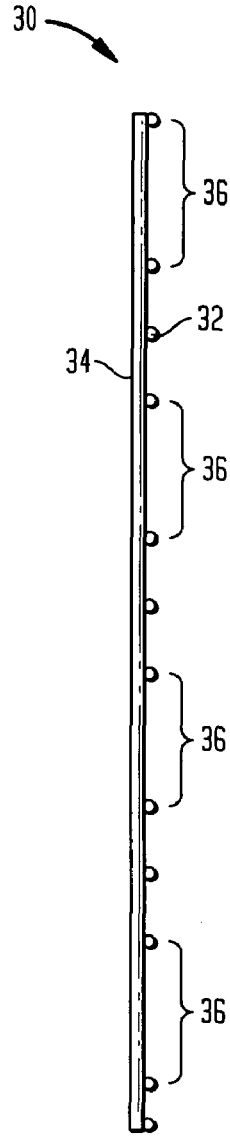
FIG. 4 shows a side view of the front grid shown in FIG. 3.

FIGS. 3 and 4 show, respectively, elevation and side views of a portion of the front grid 30. As shown in FIGS. 3 and 4, the front grid 30 comprises a plurality of horizontal wires 32 and vertical wires 34 that have been mounted together, using soldering or other suitable technique, to from a matrix of rectangular openings 36. According to the present aspect of the invention, each of the rectangular openings 36 has substantially the same shape and size. However, it would also be possible, within the spirit of the invention, for the openings 36 to have different shapes and sizes to accommodate different sizes or types of hardware.

According to a further aspect of the present invention, the matrix of openings 36 has 4 rows and 17 columns, or 68 total openings 36. However, as shown in FIG. 2, the 16th and 17th openings in the top row are blocked by the pair of display hooks 80. Also, items displayed on hooks 80 will typically hang down over the remaining openings 36 in the 16th and 17th columns. Thus, it is contemplated that in typical use, only the openings 36 in the first 15 columns will be used, for a total of 60 available openings. However, the number and arrangement of rectangular openings 36 may be freely modified without departing from the spirit of the invention.

As shown in FIG. 1, discussed above, a trailer hitch ball mount typically includes a draw bar 14 and a ball platform 12. Accordingly, in the grid 30 shown in FIG. 3, the rectangular openings 36 are dimensioned to be large enough to allow the draw bar 14 of a trailer hitch ball mount 10 to pass therethrough, while being small enough to prevent the ball platform 12 from passing therethrough.

The rear grid 40 is substantially identical to the front grid 30. However, the rear grid does not have display hooks 80. Thus, the rear grid 40 provides a second matrix of rectangular openings corresponding in position and size to the matrix of rectangular openings 36 in the front grid 30. In other words, for each rectangular opening 36 in the front grid 30, there is a corresponding rectangular opening in the rear grid 40.

Figure 5:
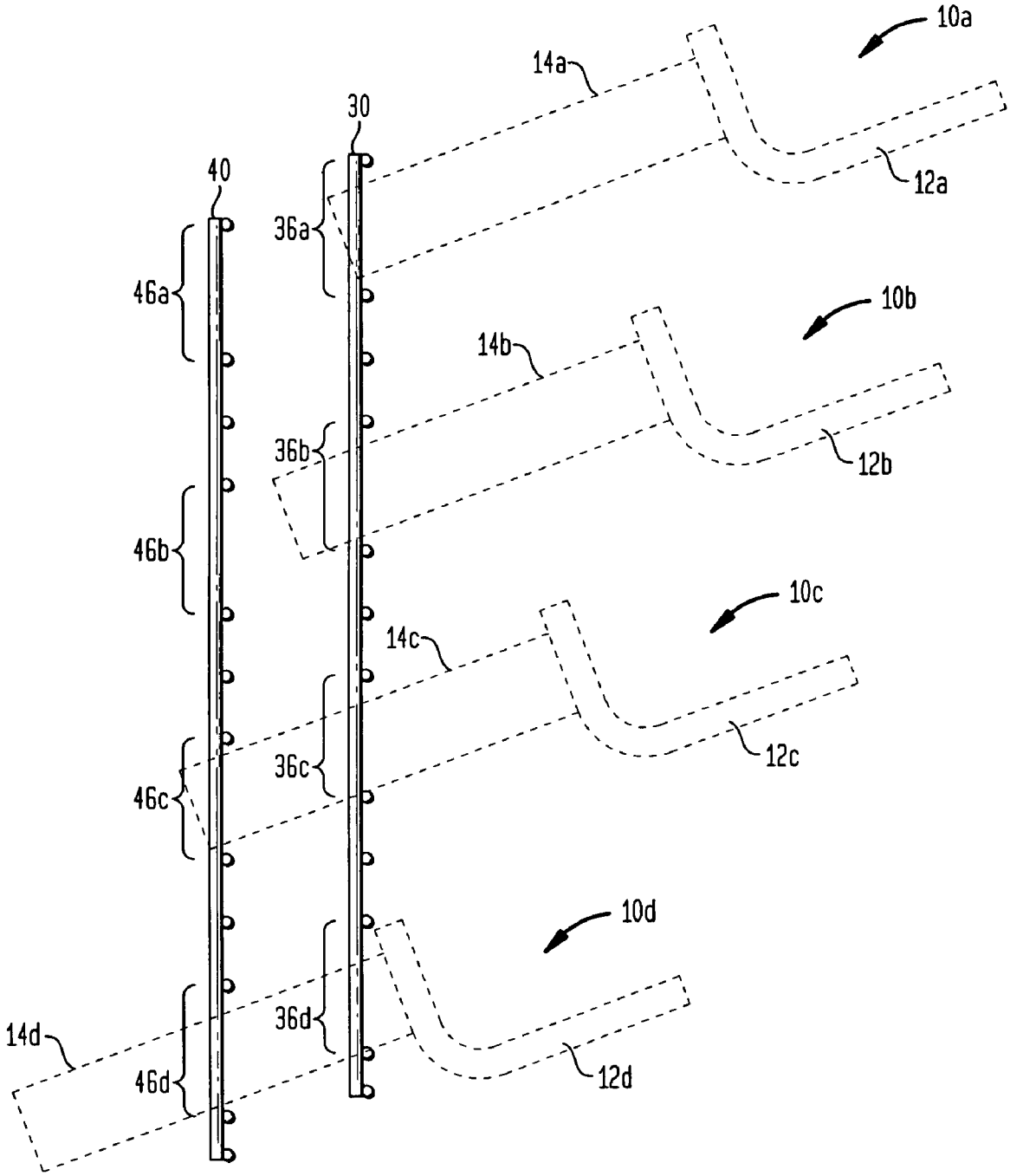
FIG. 5 shows a side view of front and rear grids suitable for use in the display unit shown in FIG. 2.

According to another aspect of the present invention, the front grid 30 is mounted with respect to the rear grid 40 such that the two grids 30 and 40 are substantially parallel to each other, with the front grid 30 slightly elevated with respect to the rear grid 30. FIG. 5 is a side view of the front grid 30 and the rear grid 40, illustrating the structural interrelationship of the two grids 30 and 40 in the assembled display unit 20 illustrated in FIG. 2. Each rectangular opening 36*a–d* in the front grid 30 and its corresponding rectangular opening 46*a–d* in the rear grid 40 together define a bay for the draw bar 14*a–d* of a trailer hitch ball mount lO*a–d*. This bay slopes downward from the front grid 30 towards the rear grid 40. The angle of the slope is approximately 20° relative to horizontal.

In FIG. 5, four ball mounts 10*a–d* are illustrated in progressive stages of being loaded onto the front and rear grids 30 and 40. First, as illustrated by ball mount 10*a*, the free end of the ball mount draw bar 14*a* is inserted into one of the rectangular openings 36*a* in the front grid 30. As illustrated by ball mount 10*b*, the draw bar 14*b* is slid through a rectangular opening 36*b* in the front grid 30. As illustrated by ball mount 10*c*, the draw bar 14*c* is then slid into a corresponding rectangular opening 46*c* in the rear grid 40. As illustrated by ball mount 10*d*, the draw bar 14*d* continues to be slid through the front and rear rectangular openings 36*d* and 46*d* until the ball platform 12*d* butts up against the front grid 30, at which point the ball mount 10*d* is in its final, seated position.

Because the front grid 30 is elevated with respect to the rear grid 40, it will be seen in FIG. 5 that in its final, seated position, the ball mount draw bar 14*d* is angled with respect to horizontal. As mentioned above, this angle is approximately 20°. However, it would be possible to modify this angle, as desired, without departing from the spirit of the invention.

The angling of the draw bar in the display unit 20 is useful for a number of reasons. The angling of the draw bar allows gravity to help in sliding a ball mount into its seated position, and will tend to hold a ball mount in its seated position. Further, a properly seated ball mount will not accidentally fall out of the display unit. In addition, the angling of the draw bar allows the ball mounts to be displayed more closely together, thus conserving shelf space.

Figure 6:
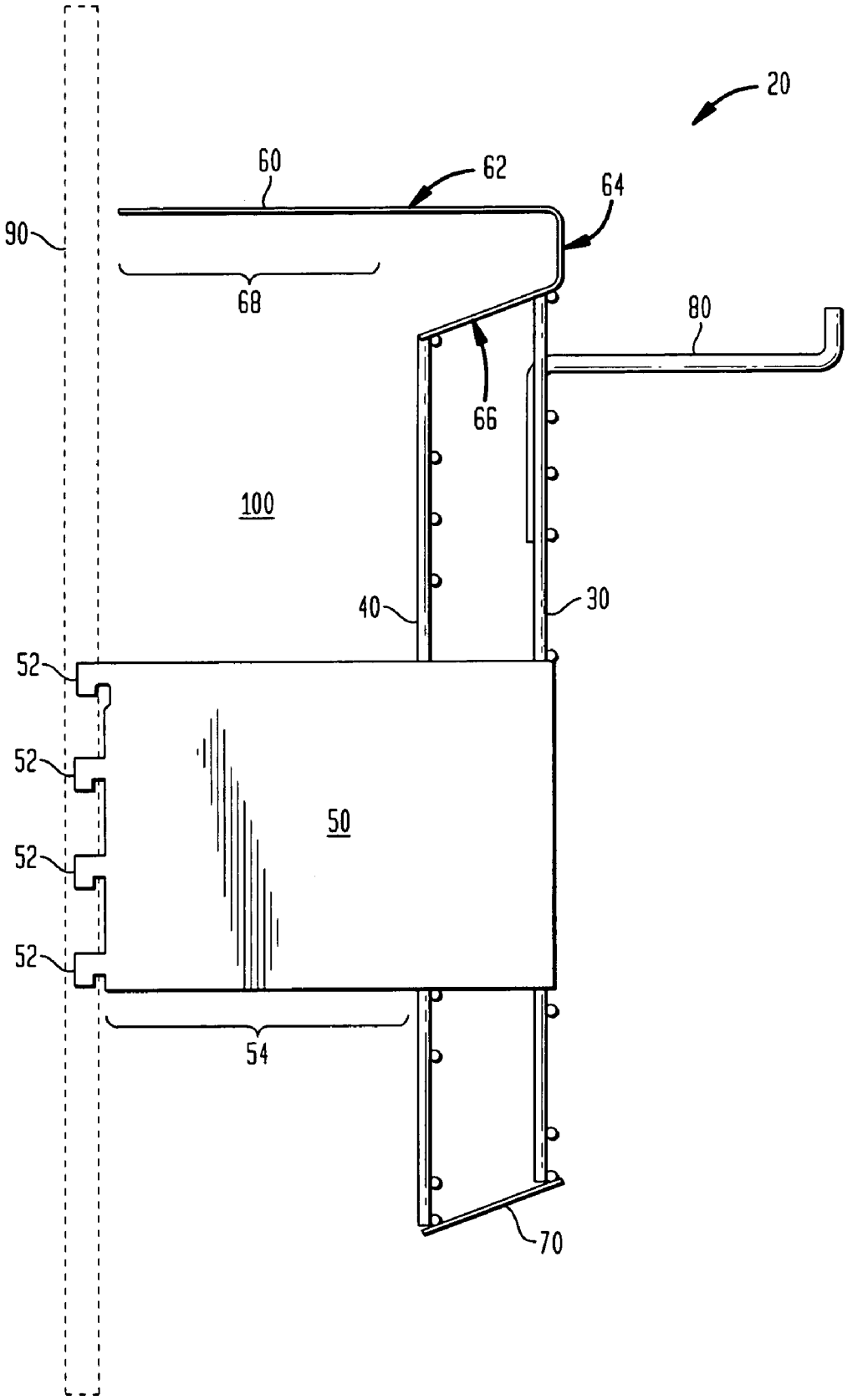
FIG. 6 shows a side view of the display unit shown in FIG. 2.

FIG. 6 is a side view of the display limit 20 shown in FIG. 2. According to an aspect of the invention, the display unit 20 includes side brackets 50 that are used to mount the display unit onto upright slotted rails 90, such as those currently used in many retail shelving systems. Each bracket 50 is provided with an array of hooks 52 that lock into position in receiving slots on the rail 90. The vertical position of the display unit 20 may be adjusted by repositioning the brackets 50 on the rail 90.

Each bracket 50 is substantially flat and rectangular in shape. The brackets 50 are mounted to the left and right edges of the front and rear grids 30 and 40. As shown in FIGS. 2 and 6, the front grid 30 is mounted proximate to the front edge of the side brackets 50, and the second grid 40 is mounted to the inside of the side brackets 50 behind the front grid 30. As discussed above, the front and rear grids 30 and 40 are mounted with respect to each other such that the front grid 30 is slightly elevated with respect to the rear grid and such that the two grids 30 and 40 are substantially parallel with each other.

As further shown in FIGS. 2 and 6, a portion 54 of the bracket 50 extends from the rear grid 40 to the support rail 90. This rearwardly extending portion 54 of the bracket 50 creates a space 100 between the rear grid 40 and the rail 90. This space 100 provides clearance for the lead end of the draw bars 14 of trailer hitch ball mounts 10 that are loaded into the display unit 20. It will be apparent that the depth of this space 100 may be modified, if desired, by increasing or decreasing the length of the rearwardly extending portion 54 of the bracket 50.

As further shown in FIG. 6, the top cap 60 is fabricated from a flat sheet of metal that has been folded to form three sections: a flat, horizontal upper surface 62, a flat, vertical front surface 64, and an underhang 66 that is folded underneath the upper surface 66. The upper edges of the front and rear grids 30 and 40 are mounted to the bottom surface of the underhang 66. As shown in FIG. 6, the underhang 66 is angled at approximately 20° with respect to horizontal. This angling causes the front grid 30 to be slightly elevated with respect to the rear grid 40.

A portion 68 of the upper surface 62 extends from the rear grid 40 towards the support rail 90. One function of this rearward extension 68 is to prevent objects from falling behind the rear grid 40 when the unit 20 is in use. In addition, if desired, the upper surface 62 may be used to hold other trailer hardware, or other items. If desired, the front vertical surface 64 may be used to display a label, or other printed matter, including pricing information, product information, and the like.

As further shown in FIG. 6, a bottom strip 70 is provided that provides support and rigidity to the front and rear grids 30 and 40. The bottom strip 70 is angled at approximately 20° with respect to horizontal. The bottom strip 70 also serves to preserve the spacing between the front and rear grids 30 and 40.

Figure 7:
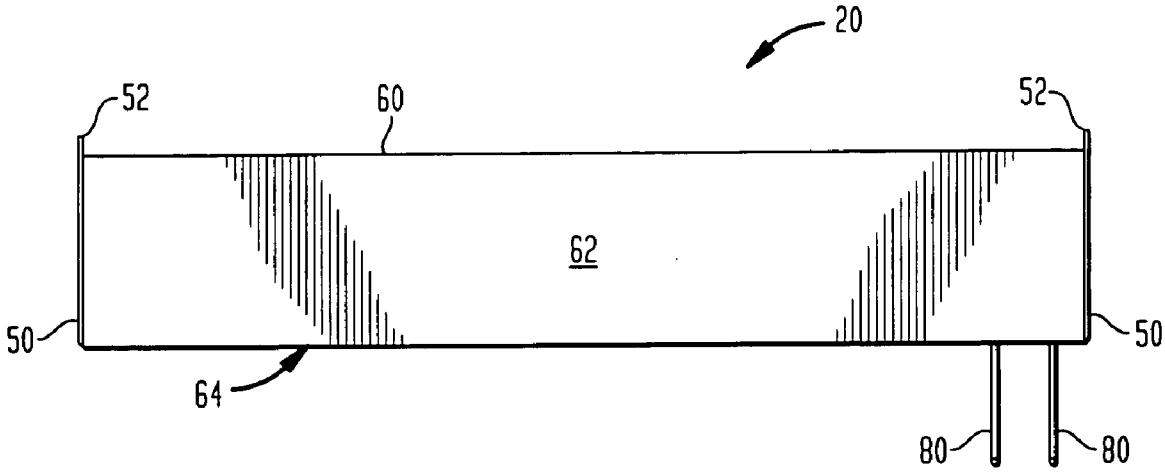
FIG. 7 shows a top view of the display unit shown in FIG. 2.

FIG. 7 shows a top view of the display unit 20. FIG. 7 illustrates the projection of the rear hooks 52 of the side brackets 50 from the rear of the display unit, and also the forward projection of the two display hooks 80 at the upper right of the unit 20.

Figure 8:
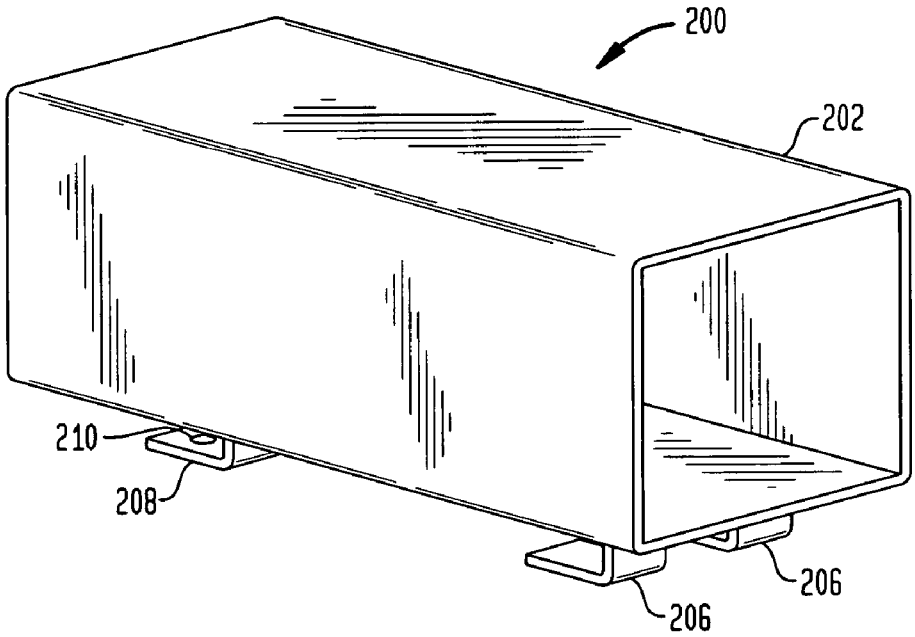
FIG. 8 shows an isometric view of an adapter unit according to a further aspect of the invention.
Figure 9:
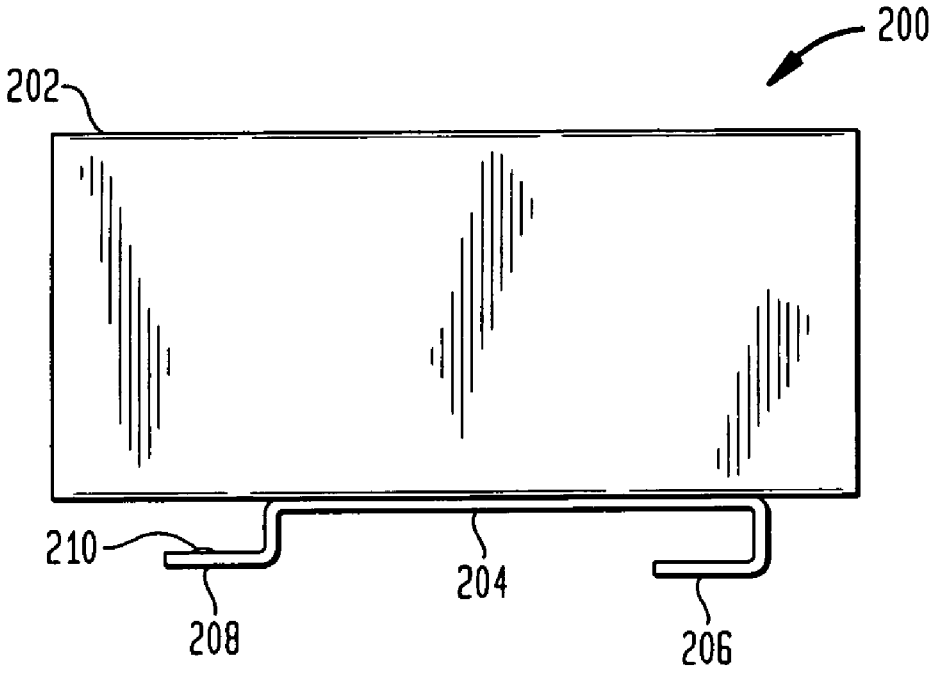
FIGS. 9–11 show, respectively, side, front, and bottom views of the adapter unit shown in FIG. 8.
Figure 10:
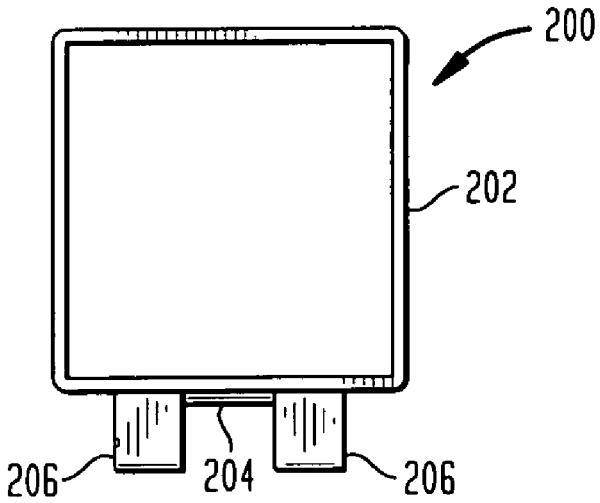
Figure 11:
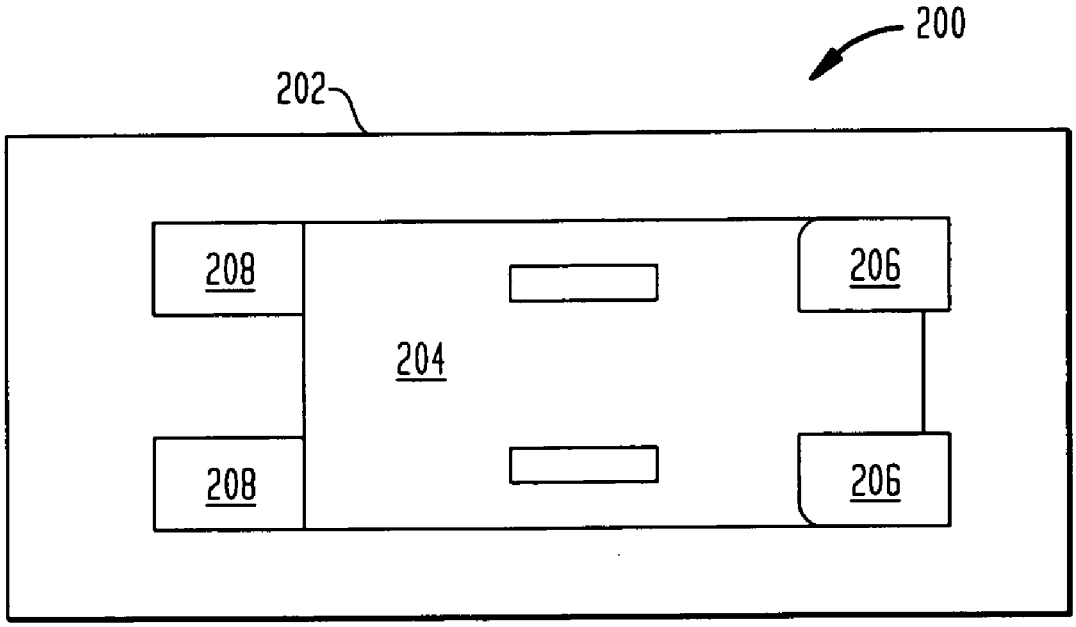

FIG. 8 shows an isometric view of an adapter unit 200 according to a further aspect of the invention. FIGS. 9–11 show, respectively, side, front and bottom views of the adapter unit. The adapter unit 200 allows the display unit to be used to hold smaller trailer hitch ball mounts. As shown in FIGS. 8–11, the adapter unit includes a tube 202 with a substantially square profile and a hook unit 204 mounted to the bottom face of the tube 202. The hook unit 204 includes a pair of front hooks 206 and a pair of rear hooks 208. The rear hooks 208 are dimensioned and shaped to grip a horizontal wire at the bottom of a rectangular opening 46 in the rear grid 40. Each rear hook 208 further includes a locking nub 210 for snapping the rear hook 208 into position after the hook 208 has gripped a horizontal wire. The rear hook 208 may be disengaged from the horizontal wire by pulling forward on the adapter unit 200.

The front hooks 206 are dimensioned and shaped to grab a horizontal wire at the bottom of a rectangular opening 36 in the front grid 30. The front and rear hooks 206 and 208 are positioned with respect to each other so that the rear hooks 208 engage the rear grid 40 at the same time that the front hooks 206 engage the front grid 30. It will be apparent that the shape of the tube 202 may be modified, as desired, without departing from the spirit of the invention. The shape, number, and position of the hooks may also be modified without departing from the spirit of the invention. In the present example, the tube 202 and hook unit 204 are fabricated from 16 gauge steel. The tube 202 has a square profile, with a height and width of approximately 1.75 inches. The length of the tube 202 is approximately 4 inches.

Figure 12:
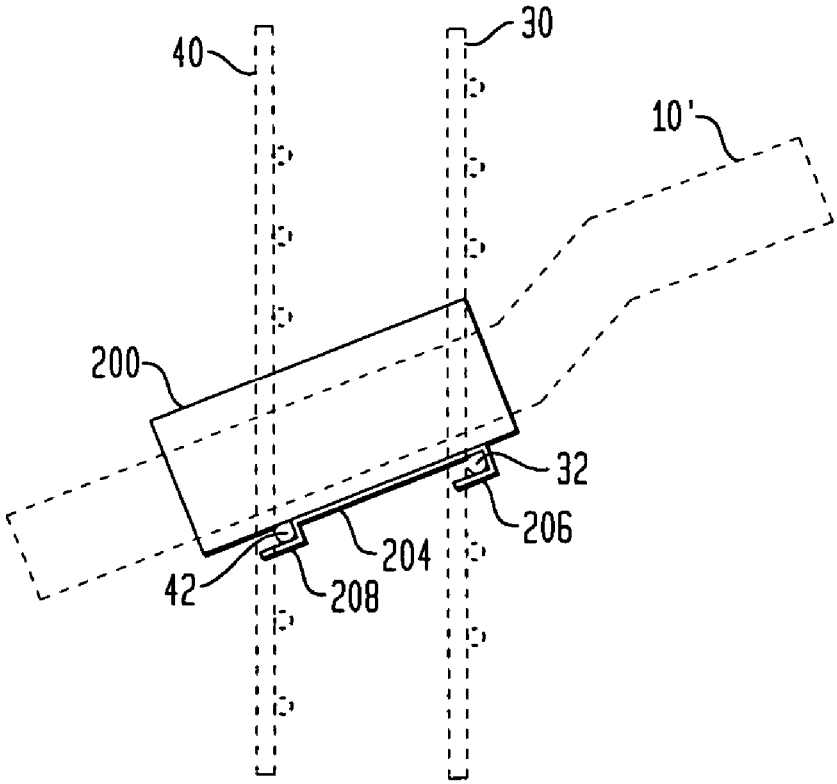
FIG. 12 shows a side view of a portion of the display unit shown in FIG. 2, illustrating the use of the adapter unit shown in FIGS. 8–11.

FIG. 12 is a side view illustrating the operation of the adapter 200. As shown in FIG. 12, the adapter 200 fits within a bay defined by corresponding rectangular openings 36 and 46 in the front and rear grids 30 and 40. FIG. 12 further illustrates how front and rear hooks 206 and 208 grip respect horizontal wires 32 and 42 in the front and rear grids 30 and 40. An exemplary trailer hitch ball mount 10' is shown in broken lines. The exemplary ball mount 10' has a shape that is significantly different from the ball mount 10 shown in FIG. 1.

A number of adapter units 200 may be stored in the vicinity of the display unit 20. A store employee or other user of the display unit 20 would then install adapter units 200 into the display unit 20, as needed. For example, if an employee is loading a smaller ball mount, such as the ball mount 10' shown in FIG. 12, the employee would first slide the adapter unit 200 into a desired position in the display unit 20, making sure that the front and rear hooks 206 and 208 properly engage the corresponding horizontal wires in the front and rear grids 30 and 40. The employee would also make sure that the locking nubs 210 in the rear hooks 208 are properly engaged. Once the adapter unit 200 is properly positioned, the employee would then load the ball mount 10' into the display unit 20 by sliding the draw bar portion of the ball mount 10' into the adapter unit tube 202. If an installed adapter unit 200 is not needed in a particular location in the display unit 20, an employee may remove the adapter unit 200 by pulling forward on the adapter unit 200 with sufficient force to disengage allow the locking nubs 210.

If desired, a display unit 20 may be provided with a number of adapter units 200 already installed into the unit. In addition, adapter units 200 may be modified without departing from the spirit of the invention. For example, adapter units 200 of various sizes and shapes may be provided to allow different items to be loaded into the display unit 20. Also, an adapter unit 200 may be provided with a closed back end, in order to allow smaller items to be stored in the adapter unit 200 without falling all the way through the adapter unit 200.

Figure 13:
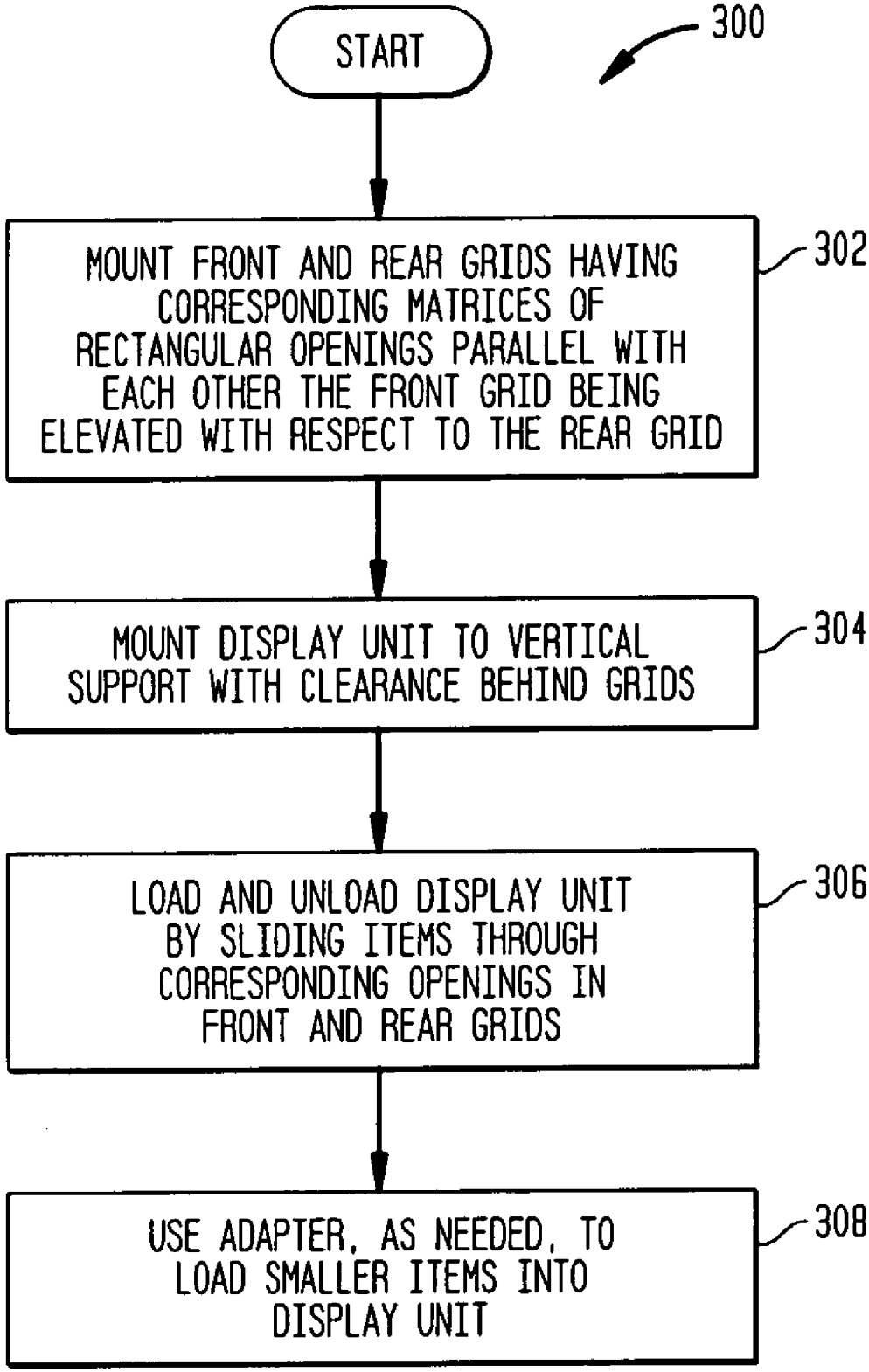
FIG. 13 shows a flowchart of a method, according to a further aspect of the invention, for displaying hardware in a retail environment.

FIG. 13 shows a flowchart of a method 300, according to a further aspect of the invention, for displaying hardware in a retail environment. In step 302, front and rear grids having corresponding matrices of rectangular openings are mounted parallel with each other, the front grid being elevated with respect to the rear grid, the front and rear grids forming a display unit. In step 304, the display unit is mounted to a vertical support, such as support rails in a shelving system. The display unit is mounted such that there is clearance between the rear grid and the vertical support. In step 306, the display unit is loaded and unloaded by sliding items through corresponding openings in the front and rear grids. In step 308, an adapter is used, as needed, to load smaller items into the display unit.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

I claim:

1. A hardware display unit comprising: a front grid (30) including a front matrix of openings; a rear grid (40) including a rear matrix of openings corresponding in position to the first matrix of openings, the front grid being positioned with respect to the rear grid such that corresponding pairs of opening in the front and the rear matrices together define downward sloping bays for hardware; first and second side brackets (50) mounted to side edges of the front and rear grids, the first and second side brackets extending a distance defined by a portion (68) behind the front and rear grids; and a cap (60) mounted to the front and rear grids, the cap including a substantially horizontal surface extending behind the front and rear grids, wherein the cap comprises three segments: a horizontal surface; a vertical surface abutting a front edge of the horizontal surface; and an underhang abutting a bottom edge of the vertical surface, the underhang extending underneath the horizontal surface, a top edge of the front grid being mounted to the underhang proximate to the underhang's front edge, and a top edge of the rear grid being mounted to the underhang proximate to the underhang's rear edge.

2. The display unit of claim 1, wherein the openings in the front and rear grids are rectangular.

3. The display unit of claim 1, wherein the display unit is adapted for mounting on a vertical supporting structure comprising a pair of vertical slotted rails mounted to a vertical surface, and wherein the first and second side brackets include hooks adapated to fit into respective receiving slots in the slotted rails.

4. The display unit of claim 1, wherein the cap's horizontal surface extends rearwardly from a front edge positioned over the front grid towards a rear edge so as to prevent objects from falling behind the rear grid when the display unit is in use.

5. The display unit of claim 1, wherein the front and rear grids comprise a plurality of horizontal and vertical lengths of wire that are mounted to each other to form the matrix of rectangular openings.

6. The display unit of claim 1, further including at least one removable adapter for narrowing a bay defined by a corresponding pair of front and rear rectangular openings.

7. The display unit of claim 6, wherein the adapter comprises a tube with a rectangular profile that fits closely within a bay defined by a corresponding pair of front and rear rectangular openings.

8. A method for displaying hardware in a retail environment, comprising:

(a) mounting front and rear grids having corresponding matrices of rectangular openings parallel with each other, the front grid being elevated with respect to the rear grid defining downwardly sloping bays, the front and rear grids forming a display unit and having a cap mounted to the front and rear grids, the cap providing a horizontal surface forming a storage area, a vertical surface abutting a front edge of the horizontal surface and an underhang abutting a bottom edge of the vertical surface, the underhang extending underneath the horizontal surface, a top edge of the front grid being mounted to the underhang proximate to the underhang's front edge, and a top edge of the rear grid being mounted to the underhang proximate to the underhang's rear edge;

(b) mounting the display unit to a vertical support with first and second side brackets mounted to the side edges of the front and grids; and (c) loading and unloading the display unit through corresponding openings in the front and rear grids; and (d) loading storage items for display on the top of the unit.

9. The method of claim 8, wherein step (b) includes providing clearance between the rear grid and the vertical support.

* * * * *